US008413980B2

(12) United States Patent
Stein

(10) Patent No.: US 8,413,980 B2
(45) Date of Patent: Apr. 9, 2013

(54) SHEET HOLDER FOR A PRINTER

(75) Inventor: Shahar Stein, Petach-Tikva (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 13/174,045

(22) Filed: Jun. 30, 2011

(65) Prior Publication Data

US 2013/0001870 A1 Jan. 3, 2013

(51) Int. Cl.
*B65H 1/00* (2006.01)

(52) U.S. Cl. ..... 271/9.11; 271/9.07; 271/145

(58) Field of Classification Search ..... 271/9.01, 271/9.07, 9.11, 145, 149, 171
See application file for complete search history.

(56) References Cited

U.S. PATENT DOCUMENTS

| | | | | |
|---|---|---|---|---|
| 4,494,746 | A * | 1/1985 | Moser | 271/164 |
| 6,299,404 | B1 | 10/2001 | Muka et al. | |
| 6,361,038 | B1 | 3/2002 | Tada et al. | |
| 6,464,449 | B1 * | 10/2002 | Takeno | 414/791.2 |
| 6,793,214 | B2 * | 9/2004 | Loose et al. | 271/149 |
| 7,063,314 | B2 * | 6/2006 | Eskey | 271/9.01 |
| 7,113,846 | B2 | 9/2006 | Moriyama et al. | |
| 7,290,762 | B2 * | 11/2007 | Connors et al. | 271/9.07 |
| 7,677,548 | B2 * | 3/2010 | Chino | 271/9.11 |
| 7,694,950 | B2 | 4/2010 | Shiohara et al. | |
| 8,191,890 | B2 * | 6/2012 | Franzone et al. | 271/149 |

FOREIGN PATENT DOCUMENTS

| | | |
|---|---|---|
| JP | 7277533 | 10/1995 |
| JP | 10203685 | 8/1998 |
| JP | 2005263474 | 9/2005 |

* cited by examiner

*Primary Examiner* — Kaitlin Joerger
(74) *Attorney, Agent, or Firm* — Steven R. Ormiston

(57) ABSTRACT

In one example, a printer sheet holding system includes: a support for printable substrate sheets in a support area; and a movable indicator to indicate the presence in the support area of a second sheet stack on top of a first sheet stack. The indicator being movable between a first position in which the indicator extends over the support area where it can rest on top of the first stack when a first stack is supported in the support area and a second position in which the indicator is withdrawn from the support area. In another example, a method includes sensing the presence of a second stack of printable substrate sheets on top of a first stack of printable substrate sheets and, in response to sensing the presence of the second stack on the first stack, configuring the printer to print on sheets of the second substrate.

7 Claims, 13 Drawing Sheets

SHEET HOLDER FOR A PRINTER

BACKGROUND

In large commercial sheet fed printers, a stack of sheets of paper or other printable substrate held in the printer's feed unit may weigh more than 100 kilograms. It is desirable to minimize the number of times a heavy sheet stack must be unloaded from the feed unit and reloaded into the feed unit, for example to accommodate the use of a different size or type substrate for an interim print job.

DRAWINGS

The same part numbers are used to designate the same or similar parts throughout the figures.

DESCRIPTION

A new stack indicator for sheet fed digital printing presses and other printers has been developed to help reduce the need to unload one substrate sheet stack before loading a second substrate sheet stack.

In one example of the new indicator, a thin flat part is placed on top of one substrate stack to indicate the presence or absence of a second substrate stack, signaling the printer controller to configure the printer for printing on the appropriate substrate. When printing on a second substrate is desired, the second substrate stack is loaded on top of the first substrate stack, covering the flat part. A sensor senses that the flat part has been covered by the second stack, signaling the printer controller to reconfigure the printer to print on the second substrate. When the second stack is removed or fully depleted, the sensor senses the flat part again (or senses that the flat part has been uncovered), signaling the printer controller to reconfigure the printer for printing on the first substrate or prompt the user to add more of the second substrate to continue printing.

In another example of the new indicator, a plate is placed on top of one sheet stack and a second sheet stack loaded on top of the plate (and the first stack). The plate prevents picking/feeding sheets from the first stack, leading to the detection of a misfeed and signaling that the second substrate has been depleted.

Figure 1:
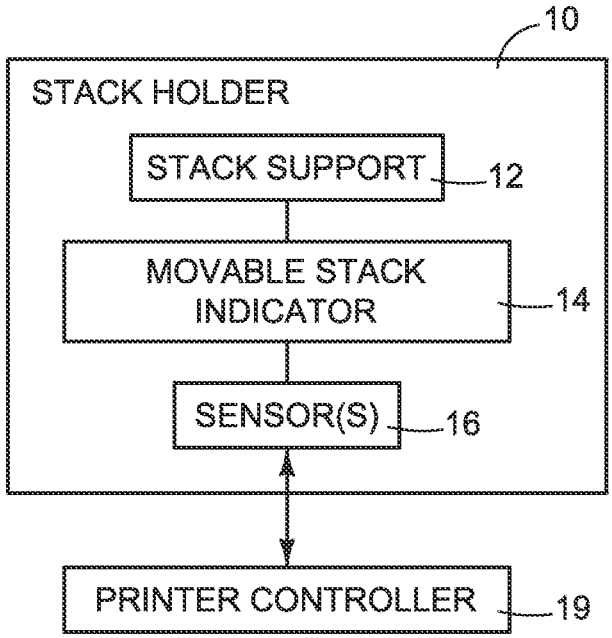
FIG. 1 is a block diagram illustrating a printer sheet stack holder according to one example of the invention.

FIG. 1 is a block diagram illustrating a printer sheet stack holder 10 implementing a new stack indicator, according to one example of the invention. Referring to FIG. 1, stack holder 10 includes a stack support 12, stack indicator 14 and one or more sensors 16. Stack holder 10 represents, for example, a drawer or cabinet for holding stacked sheets of paper or other printable substrates. Typically, stack holder 10 is part of a sheet feed unit that also includes the operative mechanical components for feeding sheets into a printer off the top stack in holder 10. The sheet feed unit may be integral to the printer or a stand-alone unit operatively connected to the printer.

Figure 2:
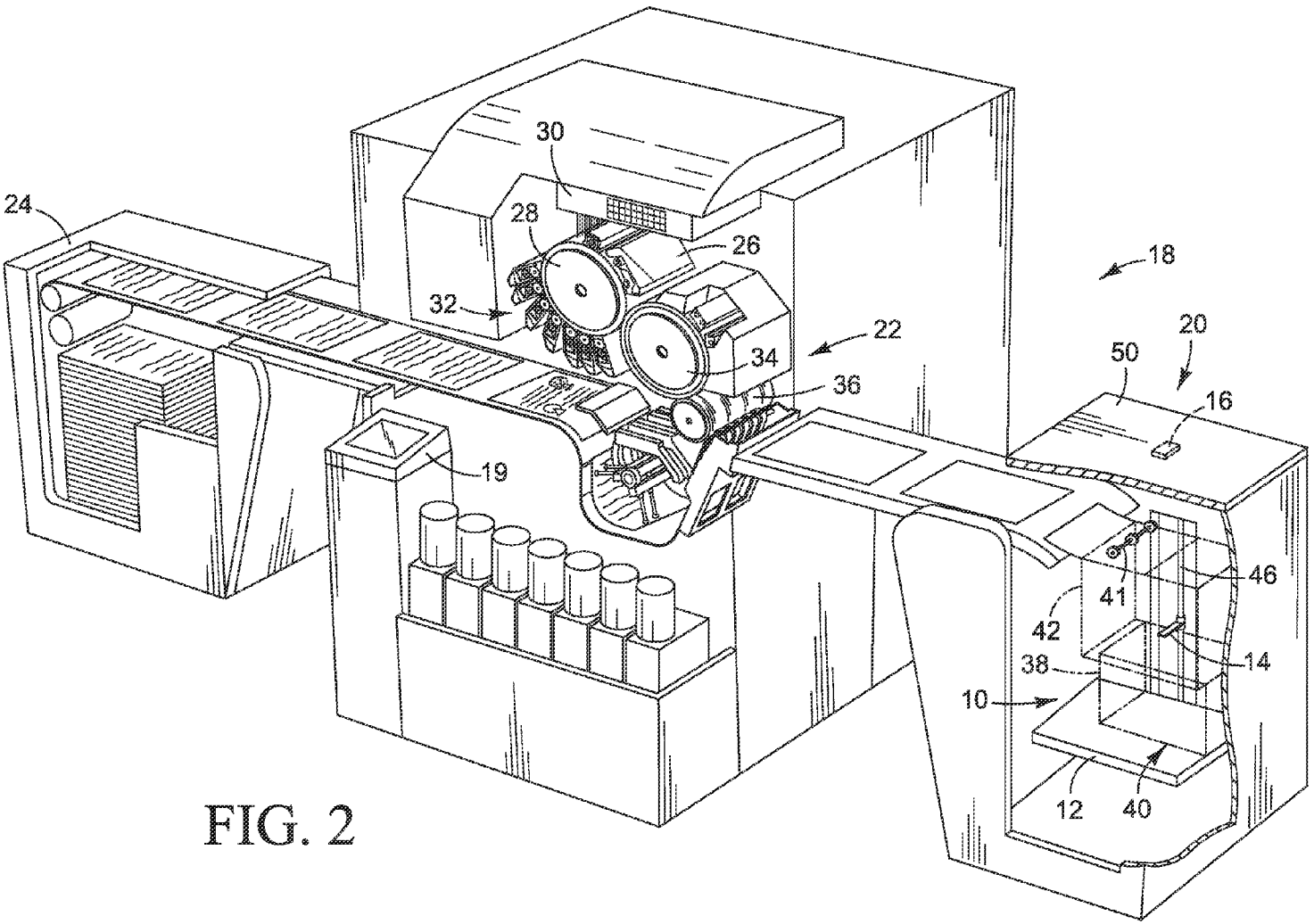
FIG. 2 is a perspective view illustrating a printer implementing a sheet stack holder according to one example the invention.

FIG. 2 is a perspective view illustrating a printer 18 implementing a sheet stack holder 10 such as that shown in FIG. 1. Printer 18 shown in FIG. 2 uses a liquid electro-photographic (LEP) printing process. LEP printer 18 is just one example of a printer that can benefit from the use of a new stack holder 10 to help reduce the need to unload one substrate sheet stack before loading a second substrate sheet stack. Referring to FIG. 2, printer 18 includes a printer controller 19, a print substrate feed unit 20 with stack holder 10, a print engine 22, and an output stacker 24. Controller 19 represents generally the programming, processor and associated memory, and the electronic circuitry and components needed to control the operative elements of printer 18. LEP print engine 22 includes a charging device 26 for charging the surface of a photoconductive drum 28. A photo imaging device 30 exposes selected areas of drum 28 to light in the pattern of the desired printed image. A thin layer of liquid toner is applied to the patterned drum 28 through a series of developer units 32 to develop the latent image on drum 28 into a toner image. The toner image is transferred from drum 28 to the outside surface of an intermediate transfer member 34. The toner image is then transferred to the print substrate as the substrate passes through a nip between intermediate transfer member 34 and a pressure roller 36.

Referring now to both FIGS. 1 and 2, a floor, platform or other suitable support 12 supports a sheet stack 38 (FIG. 2) in a support area 40 (FIG. 2) of holder 10. A typical substrate drawer or cabinet, for example, will include a fully or partially enclosed bay for holding sheet stacks loaded, for example, onto a movable elevator platform suspended in the bay. A sheet pick/feed mechanism 41 (FIG. 2) picks sheets from the top stack and feeds them toward print engine 22 (FIG. 2). Stack indicator 14 is a movable part for indicating the presence of one sheet stack 42 on top of another sheet stack 38. As described in more detail below with reference to FIGS. 3-10, stack indicator 14 is movable between a first position in which indicator 14 extends over support area 40 where it can rest on top of a first sheet stack 38 (the position shown in FIG. 2) and a second position in which indicator 14 is withdrawn from support area 40. One or more sensors 16 positioned, for example, over support area 40 and configured to sense when indicator 14 is in the first position signal printer controller 19 when indicator 14 is extended over support area 40 on top of first sheet stack 38. Sensor(s) 16 may also be configured to sense when indicator 14 is covered by second sheet stack 42.

FIGS. 3-6 are perspective views illustrating a sequence of operation for one example of a sheet stack holder 10 in which a sensor 16 is used to signal a substrate change. In the example shown in FIGS. 3-6, indicator 14 is constructed as a thin flat part 44 mounted to a shaft 46 through a collar 48. Collar 48 rotates around shaft 46 and slides up and down on shaft 46. Thus, indicator flat part 44 can be rotated on shaft 46 into and out of support area 40 and translated up and down along shaft 46 to the desired elevation for resting on the top of sheet stack 38. In this example, sensor 16 is mounted over support area 40 in a cover 50. An optical sensor 16, for example, may include a light source and a light detector housed together in cover 50. Other suitable sensor configurations are possible.

Figure 3:
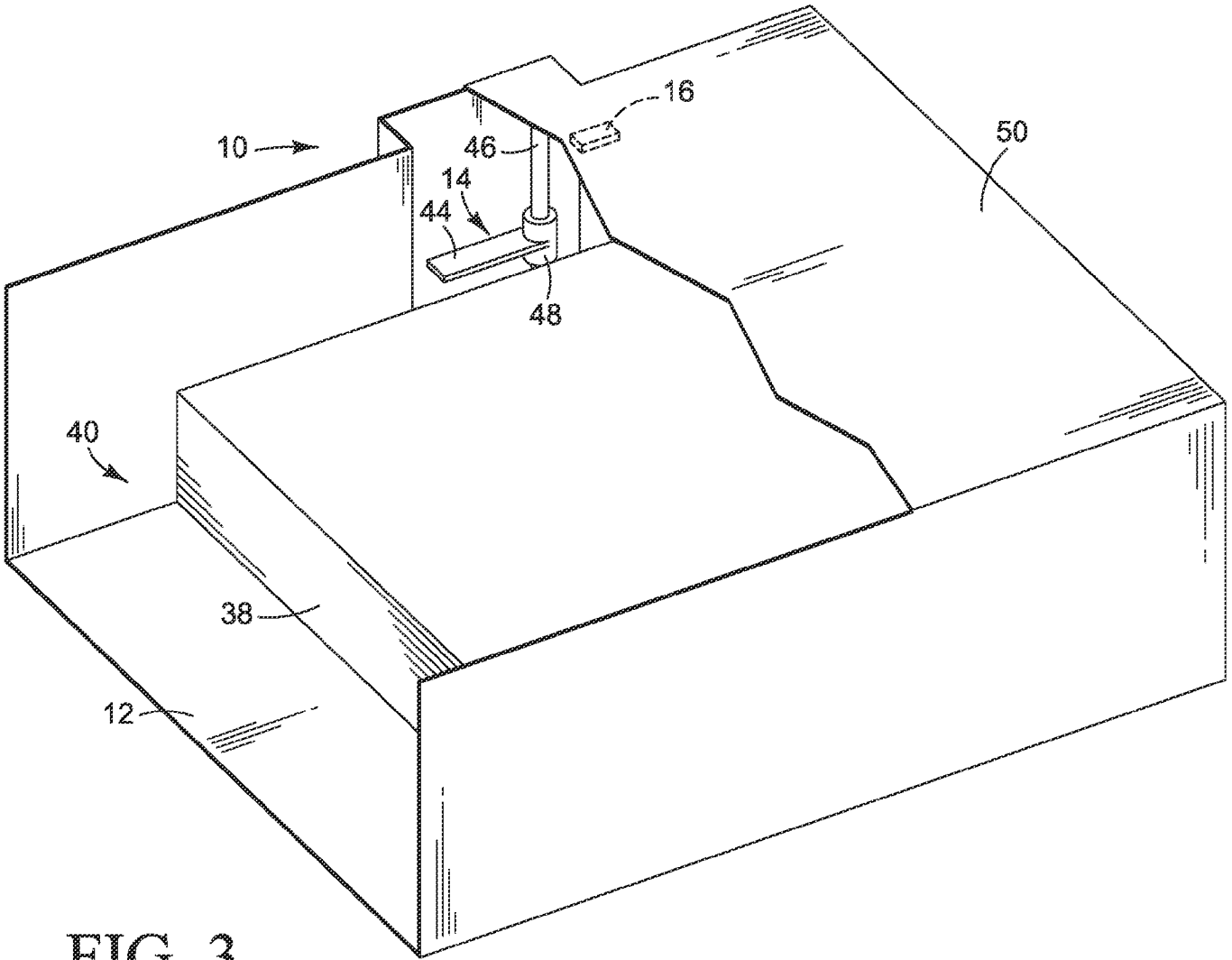
FIGS. 3-6 are perspective views illustrating a sequence of operation for a sheet stack holder that includes a single stack indicator and one indicator sensor, according to one example of the invention.

Referring first to FIG. 3, a first sheet stack 38 has been loaded onto stack support 12 in holder 10. Indicator flat part 44 is withdrawn from stack support area 40 and sensor 16 does not sense flat part 44 on top of stack 38. Depending on the technology used for sensor 16 and the associated signal processing between sensor 16 and controller 19 (FIGS. 1 and 2), sensor 16 may affirmatively or passively signal the absence of flat part 44 on stack 38 to controller 19. In any case, for this position of indicator 14, printer 18 is configured to print on substrate sheets in first stack 38.

Figure 4:
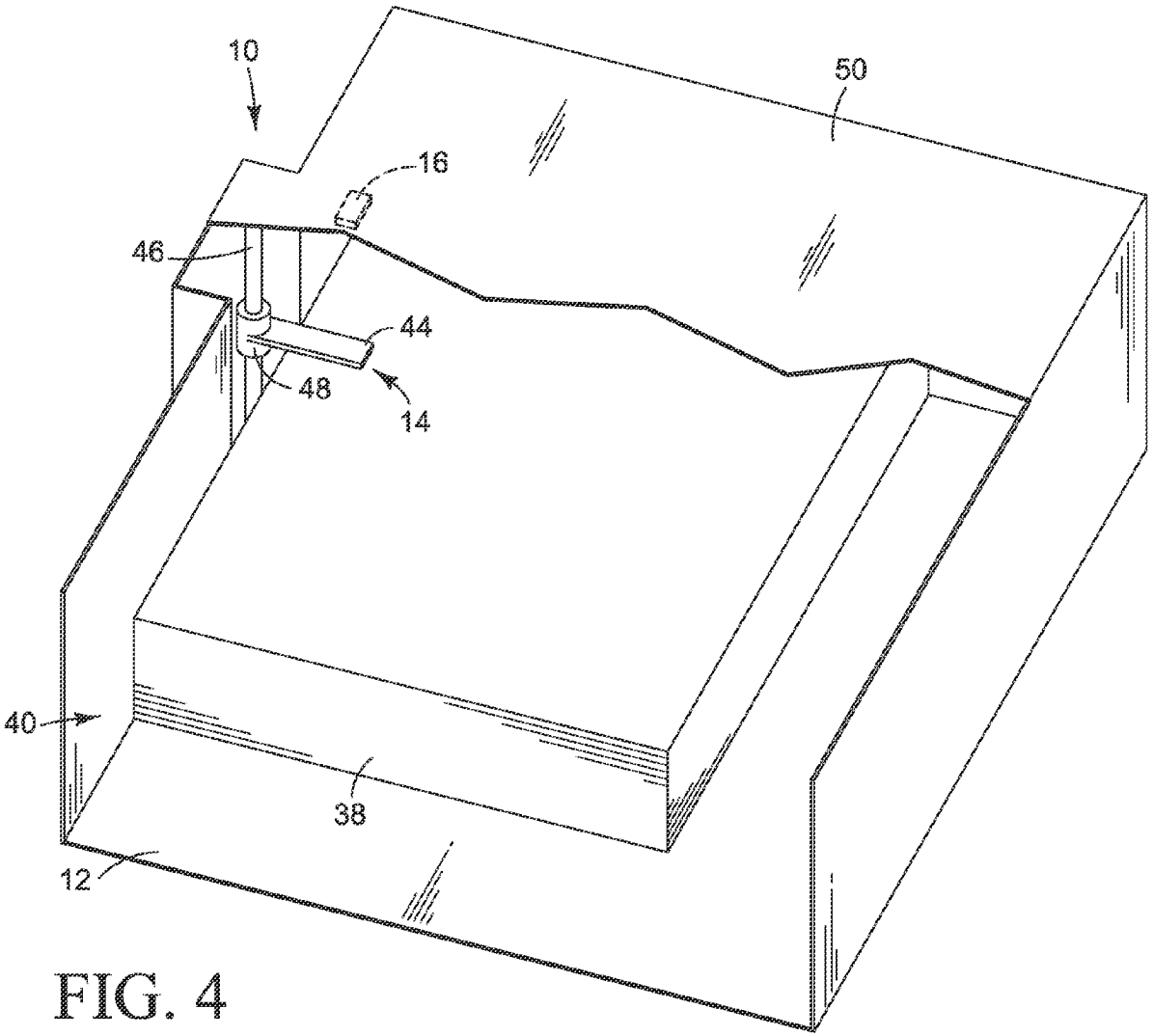

Referring to FIG. 4, indicator flat part 44 is extended into support area 40 and sensor 16 senses flat part 44 on top of stack 38. For example, in some printing environments one size sheet is used for most print jobs. Occasionally, a print job may require a different size sheet or a different type of print substrate. When printing on other sheets is required, indicator 14 is moved to the position shown in FIG. 4. For this position of indicator 14, printer 18 may be reconfigured to print on substrate sheets in second sheet stack 42. Alternatively, printer controller 19 may take no configuration action in response to a signal from sensor 16 sensing flat part 44 over stack 38, awaiting a further signal as noted below.

Figure 5:
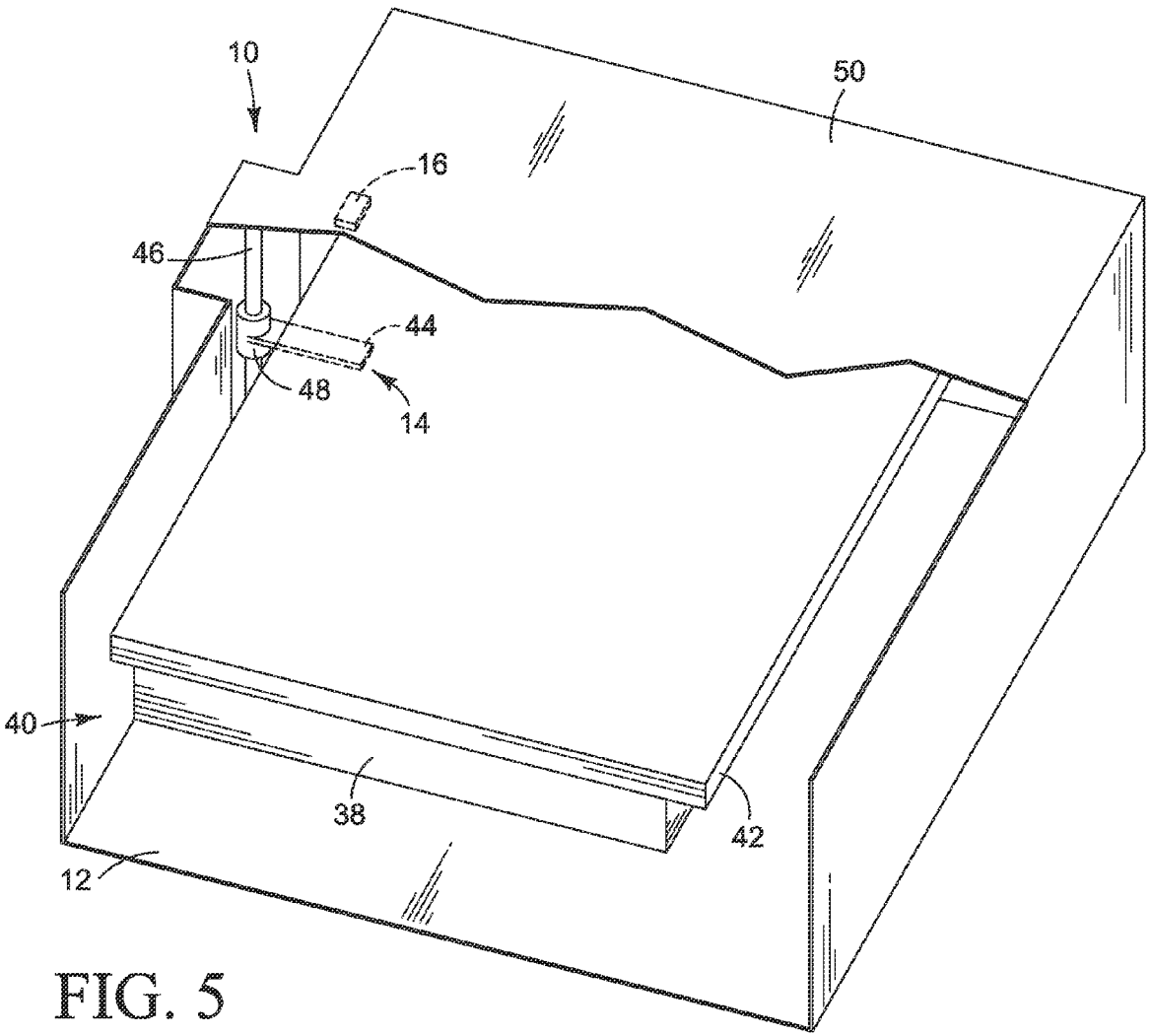

Referring to FIG. 5, a second sheet stack 42 is loaded into holder 10 on top of first sheet stack 38. If desired, sensor 16 senses flat part 44 extending into support area 40 covered by second sheet stack 42. For this position of indicator 14, printer 18 is reconfigured to print on substrate sheets in stack 42 if it has not already been so configured. Thus, two modes of operation are possible. In one mode, printer controller 19 initiates printer reconfiguration any time sensor 16 senses flat part 44 on top of stack 38. In another mode, controller 19 does not initiate printer reconfiguration until sensor 16 senses flat part 44 covered by second stack 42.

Figure 6:
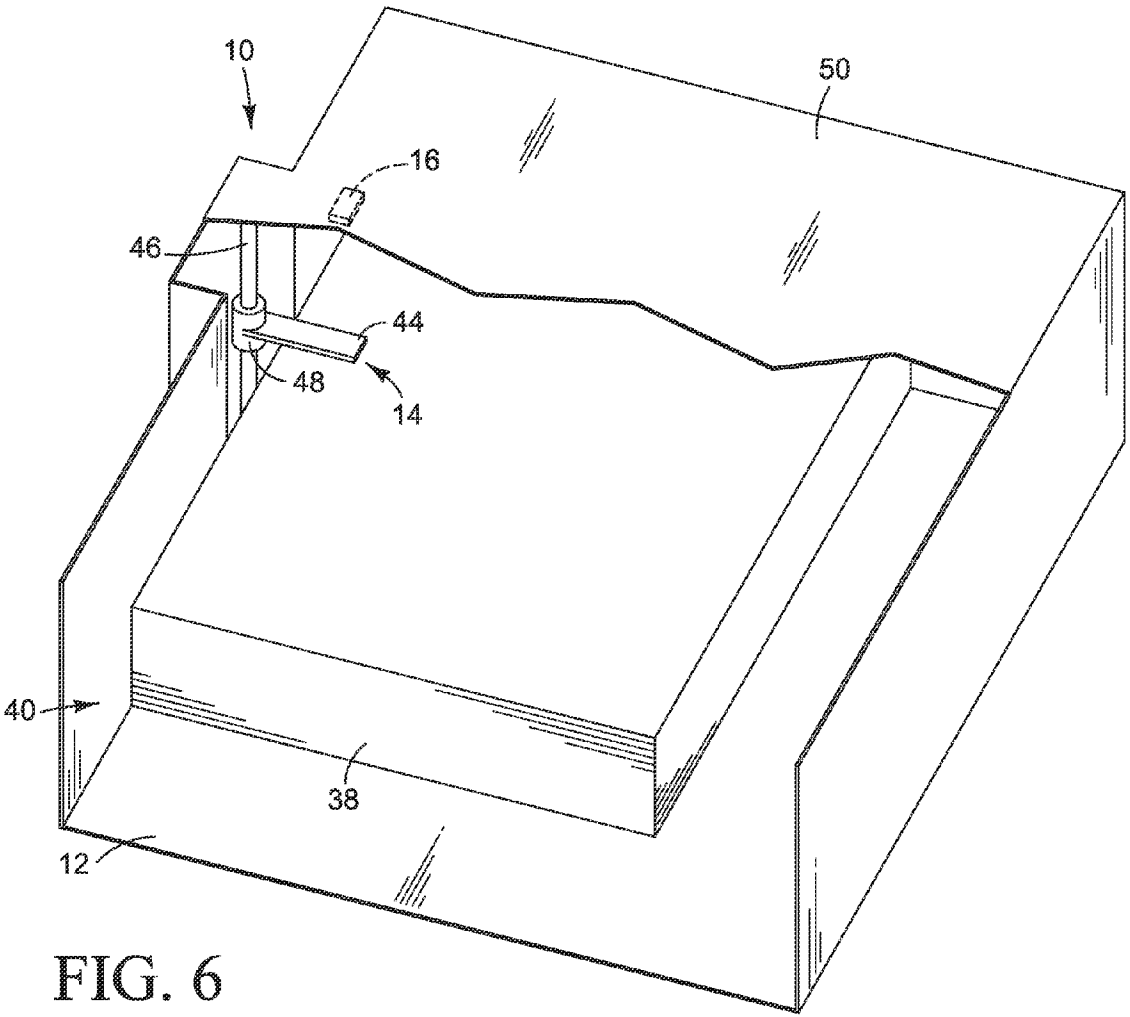

When second stack 42 is depleted or removed, as shown in FIG. 6, sensor 16 senses flat part 44 uncovered on stack 38. Printer 18 may be reconfigured at this time for printing again on substrate sheets from first stack 38. Alternatively, printer controller 19 may take no configuration action in response to a signal from sensor 16 sensing flat part 44 over stack 38, awaiting the withdrawal of indicator flat part 44 from stack support area 40 to the position shown in FIG. 3.

FIGS. 7-10 are perspective views illustrating a sequence of operation for another example of a sheet stack holder 10 in which dual sensors 16A and 16B are used to signal a substrate change. In FIGS. 7-10 dual sensors 16A and 16B represent, for example, a micro-switch 16A on shaft 46 that is triggered when part 44 moves into and out of position over support area 40 on top of stack 38 and a pressure sensor 16B embedded in part 44 that signals the presence/absence of second substrate stack 42 on top of stack 38.

Figure 7:
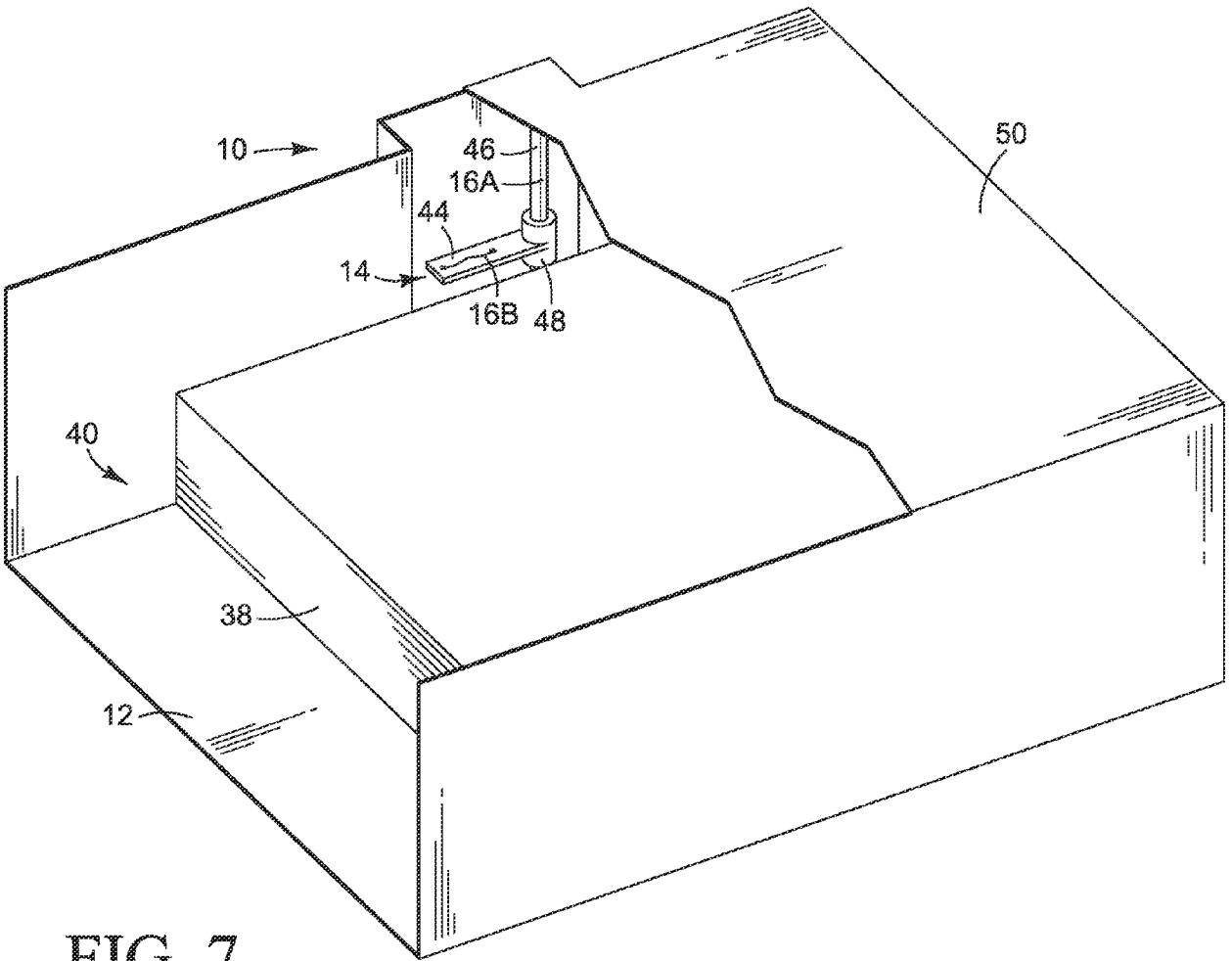
FIGS. 7-10 are perspective views illustrating a sequence of operation for a sheet stack holder that includes a single stack indicator and two indicator sensors, according to one example of the invention.

Referring first to FIG. 7, first sheet stack 38 has been loaded onto stack support 12 in holder 10. Indicator flat part 44 is withdrawn from stack support area 40 and sensor 16A does not signal the presence of indicator flat part 44 in support area 40 over stack 38. For this position of indicator 14, printer 18 is configured to print on substrate sheets in first stack 38.

Figure 8:
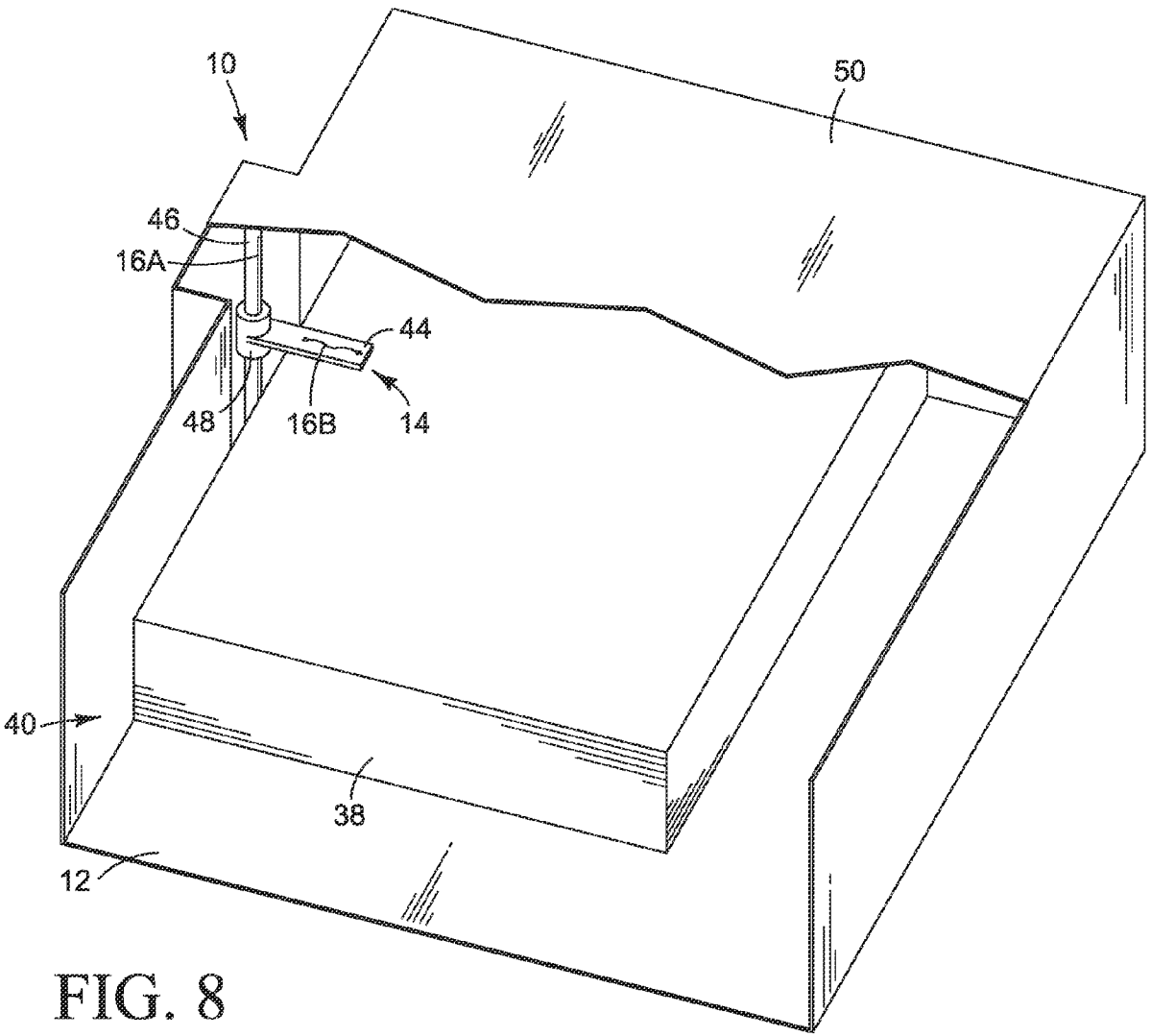

Referring to FIG. 8, indicator flat part 44 is extended into support area 40 and sensor 16A signals the presence of flat part 44 on top of stack 38. For this position of indicator 14, printer 18 may be reconfigured to print on substrate sheets in stack 42. Alternatively, printer controller 19 may take no configuration action in response to a signal from sensor 16A indicating flat part 44 over stack 38, awaiting a further signal as noted below.

Figure 9:
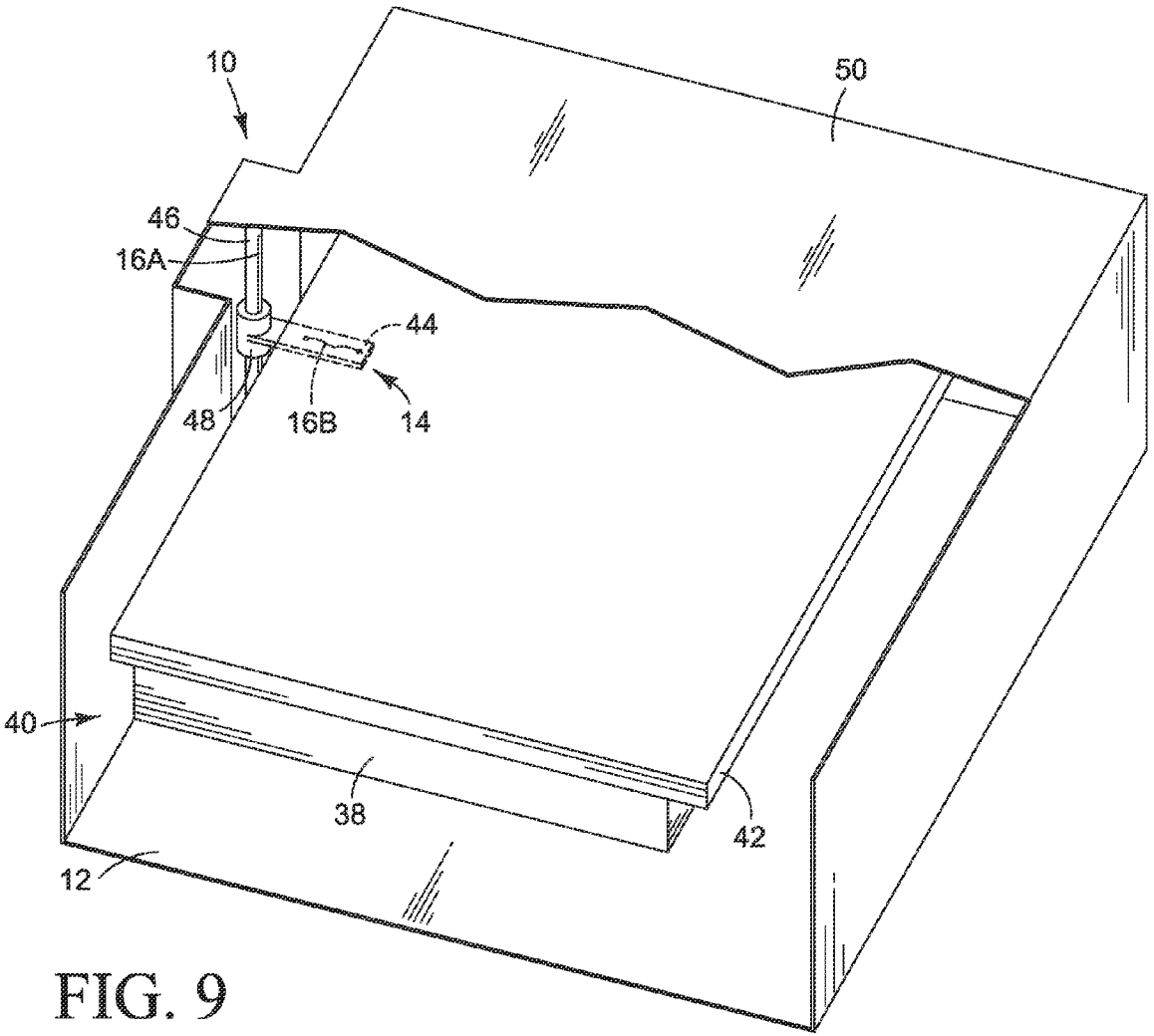

Referring to FIG. 9, a second sheet stack 42 is loaded into holder 10 on top of first sheet stack 38. Sensor 16B signals the presence of second sheet stack 42 covering flat part 44. For this position of indicator 14, printer 18 is reconfigured to print on substrate sheets in stack 42 if it has not already been so configured.

Figure 10:
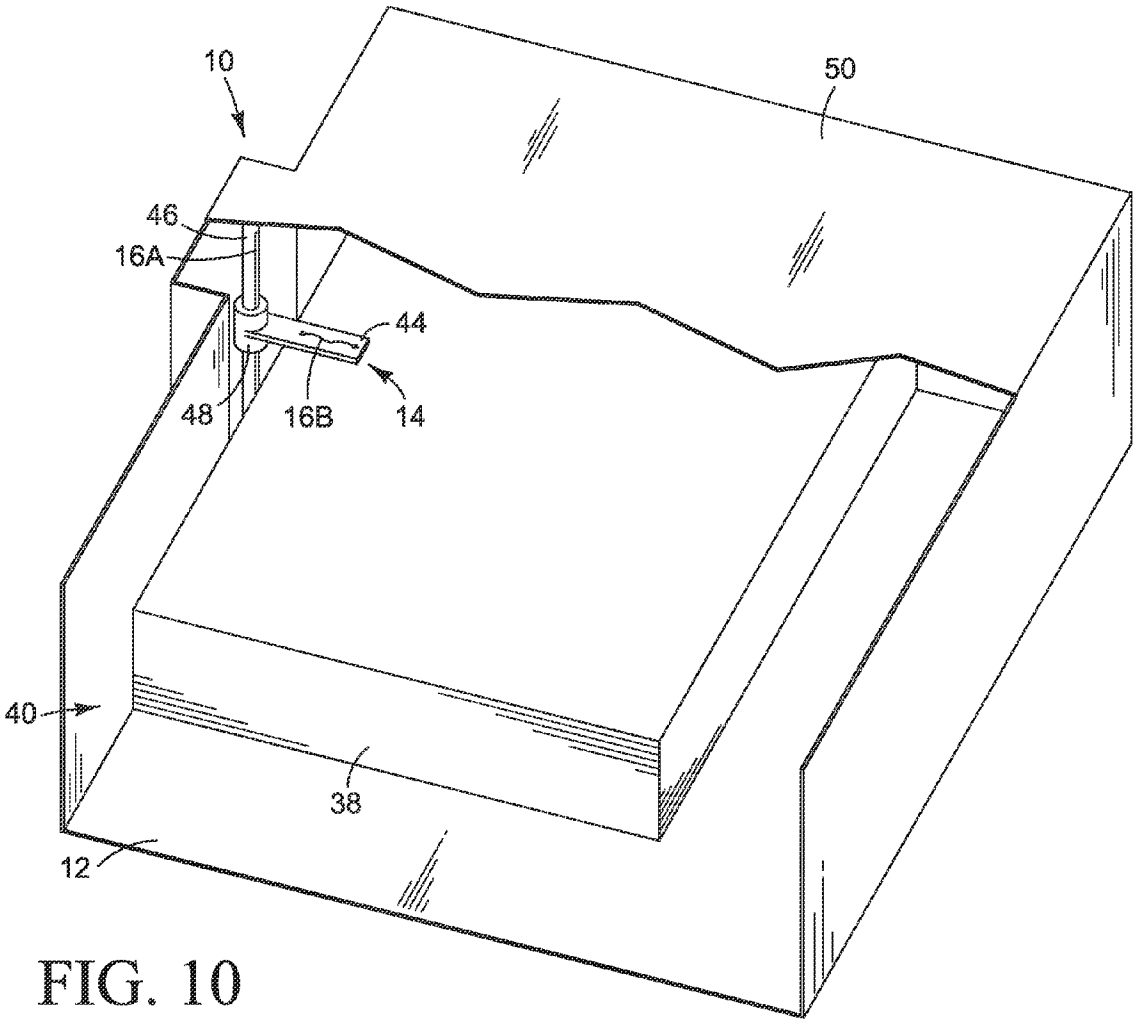

When second stack 42 is depleted or removed, as shown in FIG. 10, sensor 16B signals the absence of stack 42 and printer 18 may be reconfigured at this time for printing again on substrate sheets from first stack 38. Alternatively, printer controller 19 may take no configuration action in response to a signal from sensor 16B, awaiting a signal from sensor 16A that indicator flat part 44 has been withdrawn from stack support area 40 to the position shown in FIG. 7.

Any suitable sensor technology may be used in sheet holder 10. Thus, sensor 16 in FIGS. 3-6 and sensors 16A and 16B in FIGS. 7-10 described above are non-limiting examples.

Figure 11:
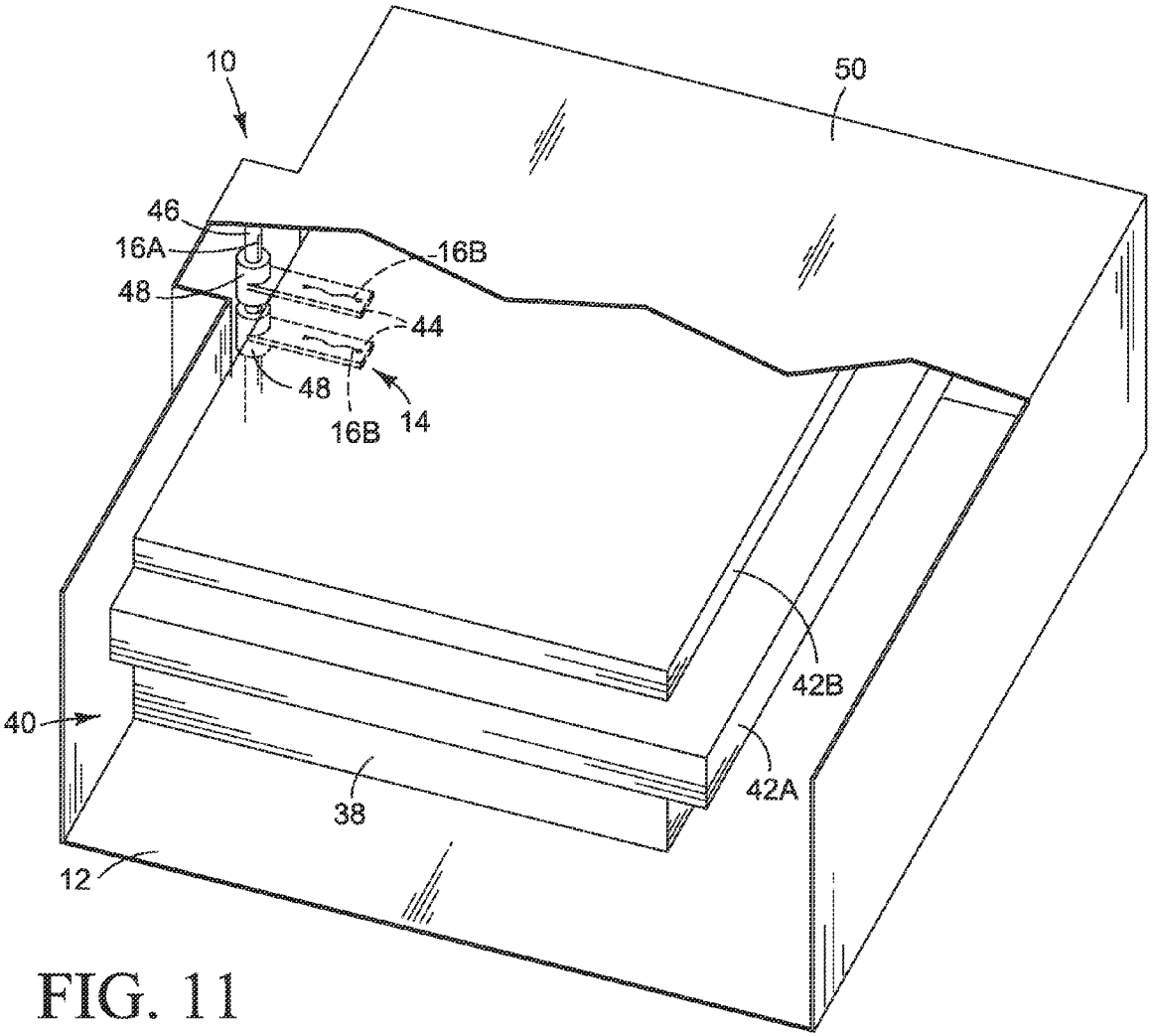
FIG. 11 is a perspective view illustrating a sheet stack holder that includes a pair of stack indicators for three sheet stacks, according to one example of the invention.

As shown in the example of FIG. 11, multiple stack indicators 44 may be used to signal the presence of second and third substrate sheet stacks 42A and 42B over first sheet stack 38.

Figure 12:
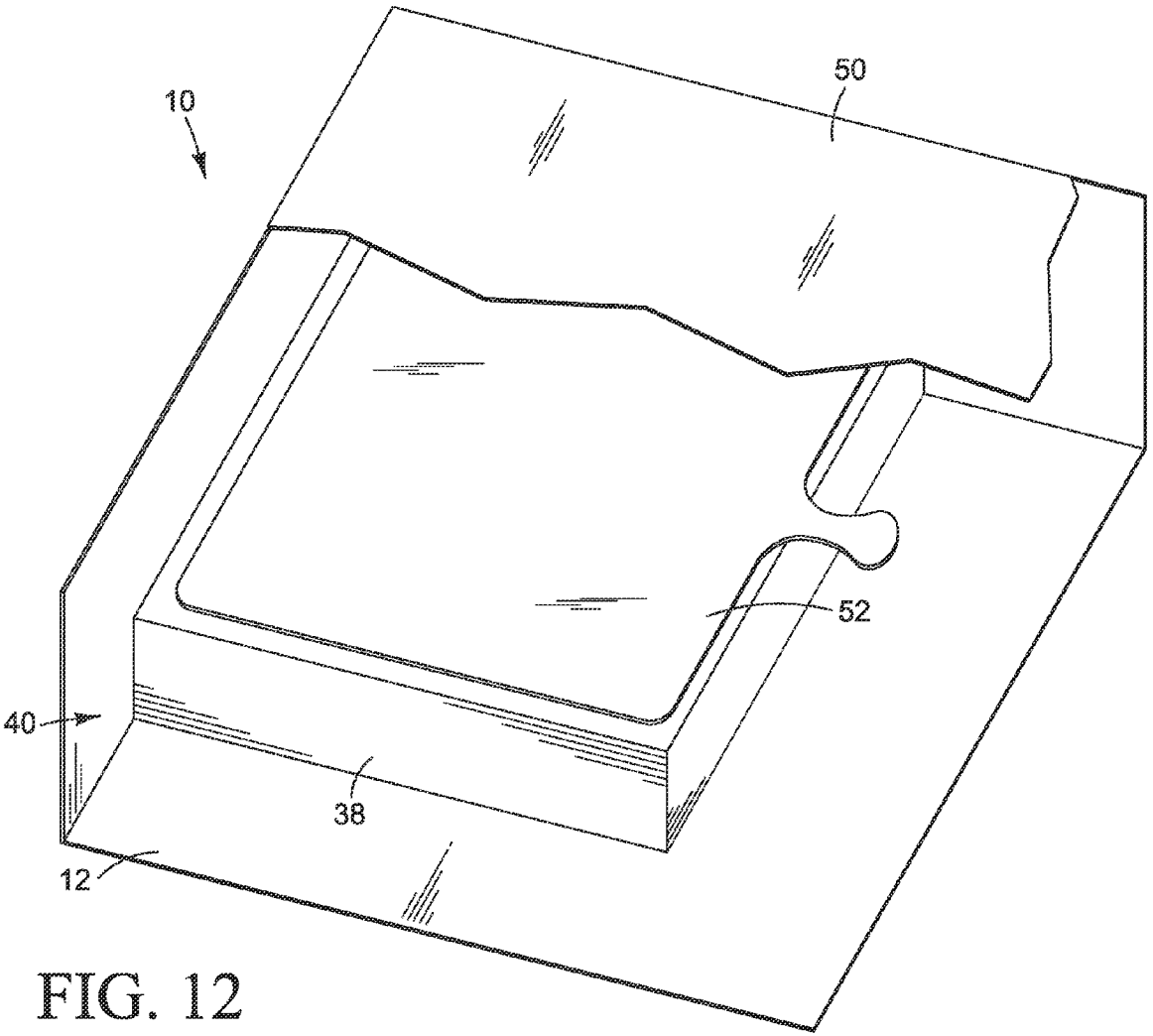
FIGS. 12 and 13 are perspective views illustrating another example of the invention in which a heavy flat plate is used for the stack indicator.
Figure 13:
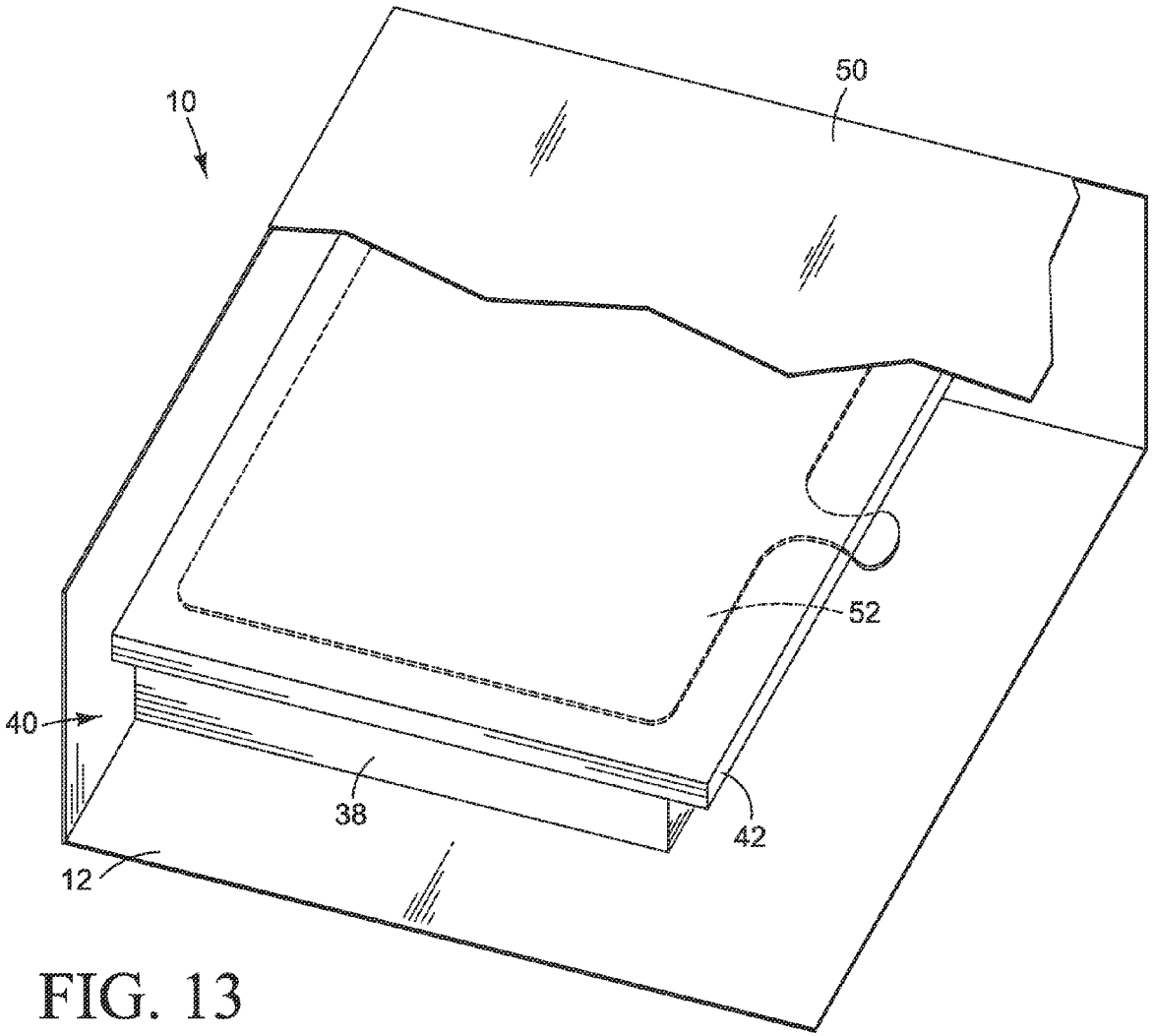

In another example of sheet holder 10 shown in FIGS. 12 and 13, a plate 52 is used for stack indicator 14. Referring to FIG. 12, plate 52 is placed over support area 40 on top of first sheet stack 38. Then, as shown in FIG. 13, second sheet stack 42 is loaded onto plate 52. Plate 52 is configured to prevent the printer pick/feed mechanism 41 (FIG. 2) from picking the indicator plate as it would a sheet of print substrate. For example, a "heavy" plate 52 covering the pick area on stack 38 will cause a misfeed when the second substrate stack 42 has been depleted so the printer controller 19 (FIG. 2) can determine automatically that the second print substrate has been depleted after one (or more) failed attempts to pick plate 52. Thus, "heavy" in this context means heavy enough to prevent the printer feed mechanism from picking the indicator plate as it would a sheet of print substrate. In this example for a stack indicator 14, the operator manually signals the printer to print on the second substrate. Alternatively, a sensor may be used to automatically detect the presence of plate 52 on stack 38 and signal printer controller 19 (FIG. 2) to print on the second print substrate.

The examples shown in the figures and described above illustrate but do not limit the invention. Other examples, embodiments and implementations are possible. Therefore, the foregoing description should not be construed to limit the scope of the invention, which is defined in the following claims.

What is claimed is:

1. A sheet holding system for a printer, comprising:

a support to support printable substrate sheets in a support area;

a movable indicator to indicate the presence in the support area of a second stack of printable substrate sheets on top of a first stack of printable substrate sheets, the indicator movable between a first position in which the indicator extends over the support area where it can rest on top of the first stack when a first stack is supported in the support area and a second position in which the indicator is withdrawn from the support area; and a sensor configured to sense the presence of the indicator in the first position.

2. The system of claim 1, wherein the sensor comprises a sensor configured to sense the presence of the indicator in the first position uncovered and to sense the presence of the indicator in the first position covered by a second stack of printable substrate sheets on top of a first stack of printable substrate sheets.

3. The system of claim 2, wherein the sensor comprises:

a first sensor configured to sense the presence of the indicator in the first position whenever the indicator is in the first position; and a second sensor configured to sense the presence of the indicator in the first position covered by a second stack on the first stack.

4. A sheet holding system for a printer, comprising:

a support to support printable substrate sheets in a support area; and a movable indicator to indicate the presence in the support area of a second stack of printable substrate sheets on top of a first stack of printable substrate sheets, the indicator movable between a first position in which the indicator extends over the support area where it can rest on top of the first stack when a first stack is supported in the support area and a second position in which the indicator is withdrawn from the support area, wherein the indicator comprises a thin flat part rotatable horizontally between the first and second positions and translatable vertically up and down above the support.

5. The system of claim 4, further comprising a first stack of printable substrate sheets on the support, the thin flat part in the first position on top of the first stack, and a second stack of printable substrate sheets on the first stack such that the thin flat part is sandwiched between the first stack and the second stack.

6. A printer sheet feed unit, comprising:

a structure to support a stack of sheets of a printable substrate;

a pick/feed mechanism for picking a top sheet from a stack of printable substrate sheets on the support structure;

a movable indicator to indicate the presence and/or absence of a second stack of printable substrate sheets on top of a first stack of printable substrate sheets on the support structure, the indicator movable between a first position where it can rest on top of the first stack when a first stack is on the support structure and a second position in which the indicator is not over the stack area, wherein the indicator comprises a thin flat part movable between the first and second positions; and a sensor configured to sense the presence of the thin flat part in the first position uncovered and to sense the presence of the thin flat part in the first position covered by a second stack of printable substrate sheets on top of a first stack of printable substrate sheets.

7. The sheet feed unit of claim 6, wherein the sensor comprises:

a first sensor configured to sense the presence of the thin flat part in the first position whenever the indicator is in the first position; and a second sensor configured to sense the presence of the thin flat part in the first position covered by a second stack on the first stack.

* * * * *